US007922421B2

(12) United States Patent
McGillick, Sr. et al.

(10) Patent No.: US 7,922,421 B2
(45) Date of Patent: Apr. 12, 2011

(54) SHORELINE EROSION AND FLOOD CONTROL SYSTEM AND METHOD

(75) Inventors: Jon McGillick, Sr., Douglaston, NY (US); Jon J. McGillick, Jr., Douglaston, NY (US); Melanie McGillick, Douglaston, NY (US)

(73) Assignee: Urban Environmental Corp., Douglaston, NY (US)

( * ) Notice: Subject to any disclaimer, the term of this patent is extended or adjusted under 35 U.S.C. 154(b) by 1279 days.

(21) Appl. No.: 11/303,598

(22) Filed: Dec. 15, 2005

(65) Prior Publication Data

US 2007/0140598 A1 Jun. 21, 2007

(51) Int. Cl.
*E02B 3/08* (2006.01)

(52) U.S. Cl. ..... 405/16; 405/302.6; 220/23.4; 206/504

(58) Field of Classification Search ..... 220/23.2, 220/23.4, 23.6; 206/503, 504; 405/15–19, 405/21, 302.4, 302.6, 302.7
See application file for complete search history.

(56) References Cited

U.S. PATENT DOCUMENTS

| | | | | |
|---|---|---|---|---|
| 1,807,819 | A | 6/1931 | Altgelt | |
| 1,832,696 | A | 11/1931 | Fleming | |
| 1,955,346 | A | 4/1934 | Sherman | |
| 3,120,975 | A | 2/1964 | Tillman | |
| 3,282,621 | A | 11/1966 | Peterson | |
| 3,583,748 | A | 6/1971 | Aradt | |
| 4,010,784 | A | 3/1977 | Nattrass et al. | 150/1 |
| 4,207,937 | A | 6/1980 | Sandeman et al. | 150/1 |
| 4,253,507 | A | 3/1981 | Williamson | 150/1 |
| 4,364,425 | A | 12/1982 | Mainville | |
| 4,390,051 | A | 6/1983 | Cuthbertson | 150/1 |
| 4,480,766 | A | 11/1984 | Platt | |
| 4,594,206 | A * | 6/1986 | Grafton | 264/35 |
| 4,610,028 | A | 9/1986 | Nattrass | 383/7 |
| 4,715,635 | A | 12/1987 | Koskinen | |
| 4,817,824 | A | 4/1989 | LaFleur et al. | |
| 5,108,196 | A | 4/1992 | Hughes | 383/17 |
| 5,156,512 | A | 10/1992 | Suzuki et al. | |

(Continued)

FOREIGN PATENT DOCUMENTS

JP 2001064937 A * 3/2001

OTHER PUBLICATIONS

B.A.G. Corp., Lift Loop, Jun. 9, 2005, 6 pages.

(Continued)

*Primary Examiner* — Sunil Singh
(74) *Attorney, Agent, or Firm* — Morgan Lewis & Bockius, LLP

(57) ABSTRACT

A bulk container and method suitable for forming an interlinked wall. In one embodiment, the bulk container may generally include sidewalls, lifting straps for transporting the container, and a closeable top. Linking loops may be provided on at least one sidewall which are each configured to be engaged by connecting members to link adjacent bulk containers together for forming an interlinked wall. In one embodiment, the connecting member is a belt which may be tensioned. Another possible embodiment includes a linking strap affixed to the sidewall panel and to which the linking loops may be attached or formed as an integral part thereof. A barrier wall system and method of forming the same from interlinked bulk containers is also provided. The barrier wall system is suitable for use in, but not limited to, shoreline erosion protection and flood control applications.

27 Claims, 9 Drawing Sheets

U.S. PATENT DOCUMENTS

| | | | | |
|---|---|---|---|---|
| 5,201,446 | A | 4/1993 | Martin | |
| 5,203,633 | A | 4/1993 | Derby | 383/17 |
| 5,288,150 | A | 2/1994 | Bearman | 383/38 |
| 5,340,218 | A | 8/1994 | Cuthbertson | 383/67 |
| 5,415,614 | A | 5/1995 | Nattrass | 493/226 |
| 5,556,205 | A | 9/1996 | Gallie et al. | |
| 5,584,599 | A | 12/1996 | Knittel | |
| 5,738,443 | A | 4/1998 | Renaud | 383/67 |
| 5,924,796 | A | 7/1999 | Derby | 383/8 |
| 6,164,870 | A * | 12/2000 | Baruh | 405/114 |
| 6,186,662 | B1 | 2/2001 | Jackson | 383/16 |
| 6,334,736 | B1 * | 1/2002 | Johnson et al. | 405/114 |
| 6,394,705 | B1 | 5/2002 | Lefebvre | |
| RE37,924 | E | 12/2002 | Kellogg et al. | 220/9.2 |

OTHER PUBLICATIONS

Inter-Bulk USA, Information on Bulk Bags, Jun. 9, 2005, 5 pages.

Lanex, bulk bags (fibc), Jun. 9, 2005, 10 pages.

Flexible Intermediate Bulk Container Association, Flexible Intermediate Bulk Container (FIBCs)—Strong, Economical and Designed to fit your needs, 2004, 8 pages.

Flexible Intermediate Bulk Container Association, Common Sense Handling Guidelines for Flexible Intermediate Bulk Containers, 1998, 6 pages.

Flexible Intermediate Bulk Container Association, What is a FIBC, 1997, 2 pages.

* cited by examiner

SHORELINE EROSION AND FLOOD CONTROL SYSTEM AND METHOD

FIELD OF THE INVENTION

The present invention generally relates to bulk storage containers, and more particularly to an improved flexible bulk container system and method of use suitable for, but not limited to, shoreline erosion protection and flood control applications.

BACKGROUND OF THE INVENTION

Mitigation and control of shoreline or beach erosion has presented challenging problems to many seaside communities. Waves driven by seasonal storms if unabated can readily consume valuable and irreplaceable shoreside property. A common solution to date has consisted primarily of erecting bulkheads or barriers on the susceptible beach area to intercept and disperse incoming waves. Various materials have been used as building blocks to construct these bulkheads or barriers. One approach has been to construct the bulkhead of very heavy materials, such as large boulders or various large concrete shapes that resist dislodgement by the waves due to their weight. Due to consideration for aesthetics, and a desire not to permanently introduce additional materials which may be foreign to the natural environment, some seaside municipalities have adopted a policy of allowing bulkheads or barriers to be installed on a seasonal basis only for temporary use during peak storm season from spring to fall.

The foregoing approaches, however, have not been suitable for such temporary applications and have many drawbacks. The boulders and concrete shapes are extremely heavy and may be difficult to rig for lifting and placement by heavy machinery such as cranes or front-end loaders. Their size and weight also makes these bulkhead materials not readily portable, and expensive to transport to the installation site. Accordingly, the foregoing materials are ill-suited for shoreline protection applications where temporary placement, ease of removal, portability, and costs are a concern.

Accordingly, there is a need for an economical shoreline erosion protection and flood control system which can be readily installed at the beginning of the season and removed at the end. There is further a need for a shoreline erosion protection system that provides improved portability, ease of handling and transportation, cost-savings over conventional bulkhead materials, and preferably is environmentally benign. There is a further need for such a system which can also be used in flood control applications.

SUMMARY OF THE INVENTION

The foregoing needs are met by the present invention which provides an improved bulkhead or barrier wall system and method of use adapted for use in, but not limited to shoreline erosion protection and flood control applications. In one embodiment, a barrier wall system is provided that is comprised of a plurality of flexible bulk containers that according to one aspect of the invention are configured to be linked together. Preferably, sand is used to fill the bulk container, but other suitable fill materials may be used as well depending on the specific application needs.

Flexible bulk containers or bags (also known as flexible intermediate bulk containers or FIBCs in the industry) have been used to store and/or transport a variety of materials, such as manufactured goods, powders, agricultural products, construction materials, and excavation debris. They come in a variety of three-dimensional shapes such as tubular and rectilinear, and in sizes suited to the type and quantity of material to be stored. Bulk containers have a body made of a flexible woven natural or synthetic fabric; the latter typically being polymer-based. Bulk containers made from a polymeric fabric are light-weight yet quite strong, being capable of holding a ton or more of material. Polymeric fabrics also advantageously may be wetted without a loss in strength of the material. Accordingly, bulk containers embodying the novel features and method of use described herein are well suited for shoreline erosion protection and flood control applications.

In one embodiment, a flexible bulk container formed according to principles of the present invention preferably has a body made from a woven synthetic fabric; more preferably a polymeric-based material. In one embodiment, the body of the bulk container is made from woven polypropylene fabric preferably having two-ply construction for added strength. Although a synthetic fabric is preferred for constructing a bulk container because of its strength and ability to be wetted without a loss in performance or strength, a bulk container made of natural materials or a combination of natural and synthetic materials may be used.

Preferably, the bulk container includes sidewalls, a bottom, and an openable/closeable top. Vertical seams may be provided between adjoining sidewalls, the bottom, and top that in some embodiments are formed by stitching or welding sections of fabric together. Preferably, a means for at least partially closing the top is provided to prevent loss of a substantial amount of bulk fill material when the container is subjected to rushing water. More preferably, the top is essentially fully closeable. In one embodiment, the top includes a top panel attached to sidewalls and an elongated tubular neck connected to the top panel. The neck communicates with the interior of the bulk container and may be used to fill and empty the contents of the container. The neck preferably has one end that may be closed by any conventional means, such as drawstrings for example. In another possible embodiment, the container top includes a plurality of top flaps that may be folded over each other to close an otherwise open top. This latter top structure advantageously provides full access to the interior of the container and its contents when opened, but is also fully closeable. Other top closure arrangements may be provided so long as the contents of the bulk container remain substantially intact against the forces of rushing water and/or wave action against the exterior of the container when used in a bulkhead or barrier wall system.

Preferably, the bulk container has a closed bottom which may be formed as part of or joined to the sidewalls by stitching, welding, or other suitable means. This will help ensure that the bulk fill material does not substantially leak out from the bottom of the container when it is immersed in water and/or subjected to rushing water or wave action. Alternatively, the bulk container may be provided with an openable/closeable bottom such as a commercially-available quick-release feature to allow the contents or fill material to be quickly dumped. Accordingly, the invention is not limited by the type of bottom structure provided for the bulk container.

In one embodiment, the bulk container preferably has a three-dimensional rectilinear shape, and more preferably is in a form approximating a cube having a top, bottom, and side panels of approximately equal dimension. Rectilinear shapes are preferred to facilitate coupling or joining two or more bulk containers together into a wall or bulkhead system, as more fully described herein. However, other shapes such as tubular sidewalls, etc., may be used according to principles of the invention which is not limited in this regard.

It will be appreciated that even rectilinear bulk containers may tend to assume a slightly tubular shape with a rounded horizontal cross-section when the fill material is loaded therein. The fill material causes sidewalls to bulge slightly and assume a slightly rounded shape due to the weight of the fill material. Such bulging is typical and expected for bulk containers, and generally should not adversely affect the use of the bulk container to construct a bulkhead or wall. In one preferred embodiment, however, the sidewalls may include rigid or semi-rigid stiffening panels to resist bulging and maintain a more rectilinear container shape. In one embodiment, the stiffening panel is removeable and may be held in a receptacle such as a pocket attached to a sidewall.

According to another aspect of the invention, a preferred bulk container does not have a fully rigid frame and is at least partially collapsible. This allows the bulk containers to be advantageously folded into a relatively flat form to facilitate bailing and palletizing compactly for economical handling and shipment to the installation site where the containers can be filled with a suitable bulk material. Although a bulk container that does not have a rigid frame is preferred, a bulk container having rigid structural reinforcing or stiffening members at various locations such as at sidewall edges, corners, faces, etc.

The bulk container preferably also includes a means for lifting the containers such as lifting straps attached to or formed as an integral part of the container. In a preferred embodiment, lifting straps are provided at each top corner of the container. The lifting straps may be engaged by a forklift, backhoe, crane, or similar construction equipment to allow a filled bulk container to be hoisted, moved into position, and adjusted as required According to another embodiment, the preferred bulk container also includes a means for connecting the bulk containers together laterally and/or vertically to provide a horizontally-extending bulkhead or barrier wall system with sufficient strength to resist dislodgment of individual container units from the bulkhead due to the forces imposed by rushing water and/or waves lapping against the wall. Therefore, the structural integrity of the wall will not be compromised by displacement of individual bulk container units because each of the interconnected units are mutually supported by adjacent units; the units forming an integrated bulkhead. In another embodiment of a wall system, the containers may also be vertically stacked and interconnected.

For shoreline erosion protection applications, the preferred fill material for the bulk container is sand. The sand may be reclaimed from the beach at the installation site or new sand may be trucked to the site, either already loaded in the bulk containers or separately for filling the bulk containers at the site. Other suitable materials such as pea gravel for example, may be used in lieu of sand depending upon the types of materials permitted by local ordinances of the seaside community, availability, and material and transportation costs. These considerations will dictate the optimum fill material to be used for a given application.

Various aspects of a bulk container made according to the present invention provides the following advantages. First, woven polypropylene may be wetted and is resistant to the corrosive effects of saltwater. The preferred two-ply weave construction is also extremely strong, yet light-weight. Accordingly, an empty bulk container may be capable of holding a ton or more of fill material, yet may weigh less than ten pounds empty. In contrast to known bulkhead materials, such as boulders and large concrete shapes, the containers may be compactly folded, palletized, shipped to the installation site, and filled at the site. This considerably reduces shipping and handling costs in contrast to known bulkhead materials.

Preferably, the polypropylene fabric used for the container has a weave (threads per inch of suitable denier) tight enough to allow water to infiltrate into, but readily drain out from the container with the ebb and flow of the tide without a substantial loss of the bulk material stored within escaping through the pores of fabric. The permissible weave tightness and concomitant pore size will be readily determinable by those skilled in the art based on the specific bulk fill material to be stored in the bulk container. In addition, the top closure means provided herein will ensure that a substantial amount of fill material is not lost from the top of the container when subjected to wave action.

All of these foregoing characteristics make bulk containers having the novel features and method of use described herein an ideal, practical, and economic solution for shoreline erosion protection bulkheads or barrier wall systems which heretofore has not been recognized and fully appreciated.

The foregoing and other features and advantages of the present invention will be more readily understood upon consideration of the drawings and detailed description of the preferred embodiments which follow herein, all of which illustrate by way of example only the principles of the invention. In the definitions and descriptions provided herein, any reference to either orientation or direction is intended primarily for the convenience in describing the preferred embodiment and is not intended in any way to limit the scope of the present invention thereto; the scope of the invention being defined by the claims appended hereto, and not by the exemplary embodiments described herein.

Although the preferred embodiments of a bulk container and wall system, and method of use may be described herein in reference to shoreline erosion protection applications, the invention is not limited to such uses alone. Accordingly, the invention may be used with fresh or saline water, and in other applications such as flood control and erosion protection associated with rivers, lakes, or other impoundments of water that may breach their normal containments during storm or other events.

BRIEF DESCRIPTION OF THE DRAWINGS

The features of the preferred embodiments will be described with reference to the following drawings where like elements are labeled similarly, and in which.

DESCRIPTION OF THE PREFERRED EMBODIMENTS

Figure 1:
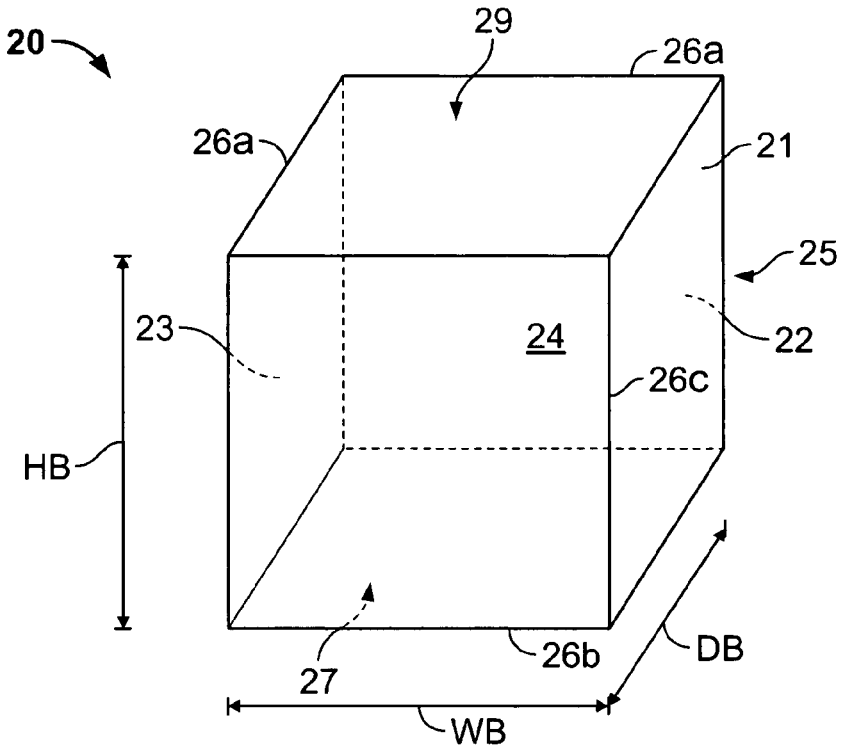
FIG. 1 shows a front perspective view of a preferred embodiment of a bulk container body in the form of a cube.
Figure 2:
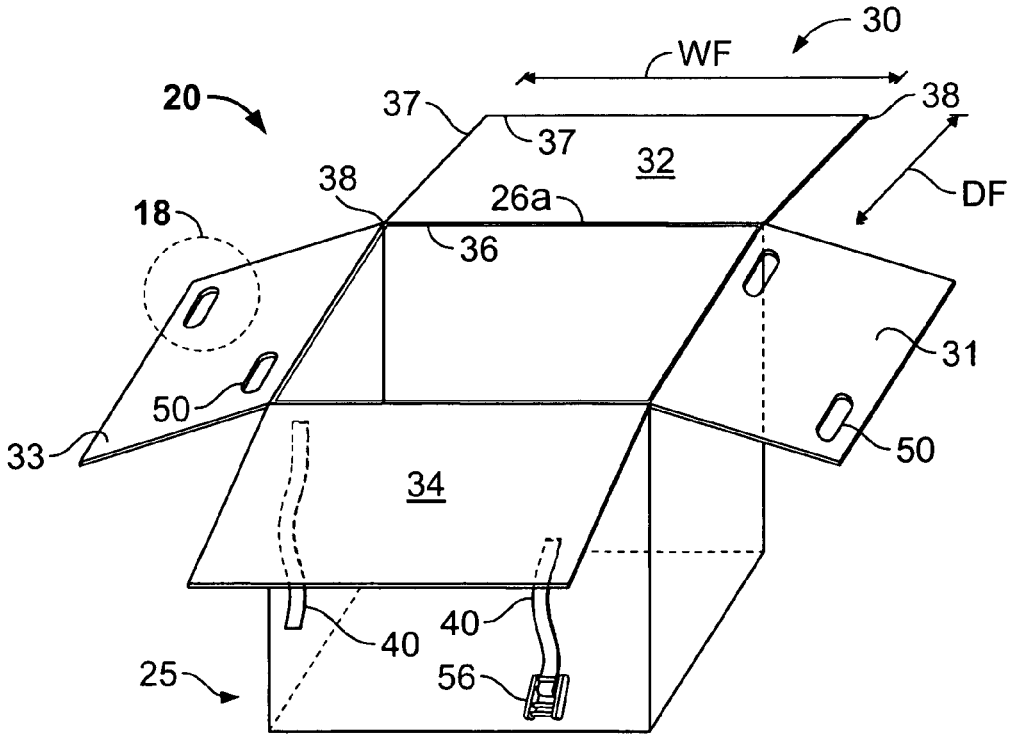
FIGS. 2-6 show front perspective views of the container body of FIG. 1 with a first possible embodiment of a closeable top having a plurality of flaps in various stages of the flaps being folded over the body.

In order that the invention may be understood, preferred embodiments which are given by way of example only, will now be described with reference to the appended drawings. Accordingly, the preferred embodiments are described for convenience of reference and without limitation of the invention to embodiments described herein. The scope of the invention being defined by the claims appended hereto FIGS. 1 and 2 are perspective views of a preferred embodiment of a flexible fabric bulk container formed according to principles of the present invention. FIG. 1 shows only the body of the bulk container without the top cover in place.

A bulk container 20 in one embodiment is depicted as including vertical sidewalls such as four sidewall panels 21, 22, 23, 24 which together define a body 25. For convenience of reference and without limitation, panels 22, 24 may be considered rear and front sidewall panels, respectively, and panels 21, 23 may be considered right and left lateral sidewall panels, respectively. Each sidewall 21-24 may have a top edge 26*a*, bottom edge 26*b*, and two longitudinally-extending vertical edges 26*c* as shown in FIG. 1. Body 25 defines an interior cavity for holding a bulk material.

Bulk container 20 further includes a floor or bottom panel 27 that is attached to the lower portion of body 25 and preferably forms a closed bottom. Sidewall panels 21-24 further define a top opening 29 as shown through which materials may be loaded into or emptied from bulk container 20.

As shown in FIG. 1, body 25 of bulk container 20 has a width WB, depth DB, and height HB. In a preferred embodiment, WB, DB, and HB are each about 3 feet to provide a bulk container storage capacity or volume of approximately one cubic yard of fill material. Other dimensions are contemplated and it will be appreciated that WB, DB, and HB may be any suitable dimension depending upon the type and weight of material desired to be stored in the bulk container, type and strength of the fabric, etc. For example, WB, DB, and HB may each be about 1 meter for a bulk container 20 that holds approximately 1 cubic meter of fill material. Accordingly, the invention is expressly not limited with regards to the preferred dimensions and volumetric capacity described herein.

Preferably, bulk container 20 is made from a flexible woven synthetic fabric such as polypropylene or another suitable synthetic of the types commonly used today for bulk containers. Such synthetic fabrics are relatively light in weight, economical to produce, and yet extremely strong. For shoreline erosion control applications exposed to water, the preferred fabric in one embodiment is two-ply polypropylene of a suitable thread count to form a weave with a porosity sufficient to allow water to infiltrate and drain back out from the bulk container without a substantial loss of the fill material stored therein. A preferred fill material for shoreline erosion control is sand. Therefore, the pores of the bulk container are preferably of an appropriate size to retain this type of fill material unless another type of fill is used.

Bulk container 20 further includes a means for closing the top of the container which in a preferred embodiment may be top cover 30. Cover 30 preferably includes a plurality of overlapping flaps to ensure that the fill material contained in bulk container 20 does not leak out by wave action. As shown in FIG. 2, cover 30 may include four top closure flaps 31, 32, 33, 34 in one embodiment. For convenience of reference and without limitation, flaps 32 and 34 may be considered rear and front top flaps, respectively, and flaps 31 and 33 may be considered right and left lateral top flaps, respectively. Each flap may include three free edges 37 and one fixed edge 36 which is secured to an upper portion of body 25, preferably along top edge 26*a* of the body. The various intersections of edges 36, 37 with each other forms four corners 38 as shown. For the sake of brevity, edges 36, 37 and corners 38 are only shown for top flap 32 in FIG. 2, but it will be recognized that each flap preferably also has three free edges 31, one fixed edge 32, and four corners 38.

Top flaps 31-34 preferably each are cooperatively configured with a sufficient width and length to completely bridge across top opening 29 from sidewall panel to sidewall panel. This arrangement provides some degree of protection against the contents being washed out of the top opening by rushing water and wave action. In the preferred embodiment, at least three flaps are provided in cooperative overlapping engagement when folded over top opening 29. This arrangement provides the top of bulk container 20 with three full thicknesses of fabric covering top opening 29 when the flaps are all folded over the opening. More preferably, however, bulk container 20 has four flaps that overlap each other and top opening 29 as shown in the figures and for reasons which will become apparent as described below.

Bulk container 20 may be constructed by joining various fabric parts together as described herein (i.e., top flaps 31-34, bottom panel 27, and side panels 21-24) along their respective edges by any conventional means commonly employed in the art. This includes, but is not limited to stitching the seams using one or more rows of a thread of suitable tensile strength and material as will be known to a skilled artisan in the industry, welding seams by chemical, heat, or adhesive means, etc. The joined edges of two or more parts will be defined and referred to herein as a "seam" regardless of the joining method.

Although sidewalls 21-24, bottom or floor panel 27, and top flaps 31-34 are shown in FIGS. 1 and 2 as being separate parts or components, it should be noted that these components need not be all separate pieces joined together along their respective edges. Rather, several of these component parts may be formed from a single piece of material which are ultimately joined together to form bulk container 20. For example, in a preferred embodiment, lateral side panels 21, 23 and bottom panel 27 may be formed from a single seamless U-shaped piece of fabric to which rear and front sidewall panels 22, 24 are attached. Alternatively, sidewall panels 21-24 may be formed from a single seamless piece of material resulting in only one vertical seam between the sidewalls.

Accordingly, the lines shown between the sidewalls, top cover, and bottom panels shown by a vertical and horizontal lines should therefore not be interpreted as requiring an actual physical edge, but may actually represent only a change in direction from panel-to-panel. Therefore, the invention is expressly not limited in this regard.

A preferred embodiment of a bulk container further includes a means for securing two or more of the top flaps 31-34 together when folded over top opening 29. Referring generally to FIGS. 2-5, and particularly to FIG. 3, in one embodiment the means for securing multiple top flaps together includes at least one of the top flaps such as top flap 34 including two straps 40 each having a fixed end 41 secured to the flap and a free end 43. Fixed end 41 may be secured to flap 34 by any method commonly used in the art, such as preferably stitching strap 40 to top flap 34 using thread of a suitable tensile strength and material, such as polypropylene, polyester, etc. In one embodiment, fixed ends 41 are arranged diagonally across from each other on top flap 34 and fastened to the top flap generally proximate two diagonally-opposed corners 38. Preferably, straps 40 are made of woven material of suitable strength to secure the top cover 30 in use such as the type used for automotive seat belts like Terylene webbing (polyethylene terephthatlate) or similar. However, any suitable strap material known in the art may be used. Straps 40 may preferably be at least 1 inch wide; and more preferably about 2 inches wide in one possible embodiment. Any suitable strap widths may be used based upon the desired strength required for a particular application.

Figure 18:
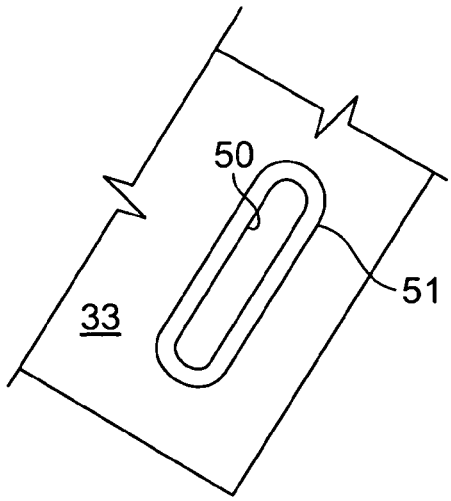
FIG. 18 shows a detailed view taken from FIG. 2 of an aperture in the flaps.

The preferred means for securing multiple top flaps 31-34 together further includes flaps 31 and 33 defining apertures 50 through which free ends 43 of straps 40 may be passed. Preferably, apertures 50 are elongated in shape such as a slit, oval, or similar (see FIG. 18) and sized to complement the size and shape of straps 40 so that free ends 43, and any fastening means for holding the free ends together that may be provided as described herein, may be passed through the apertures. The apertures, however, may have other suitable shapes such as round. The fabric surrounding the apertures preferably is reinforced to prevent tearing and/or tattering of the woven polypropylene fabric by straps 40. The reinforcement may be provided in the form of reinforced stitching surrounding aperture 50. Alternatively, the reinforcement in a preferred embodiment may be in the form of a separate plastic or metallic insert such as grommet 51 of suitable shape and size to accommodate straps 40 and any strap fastening means provided. Preferably, grommet 51 is oblong or oval in shape; however, a conventional circular grommet of sufficient diameter to allow straps 40 and any fastening means provided to be threaded through aperture 50 may be used.

It will be appreciated that other suitable means for securing two or more of the top cover flaps 31-34 together may be used so long as the top flaps are interconnected and secured together.

Figure 5:
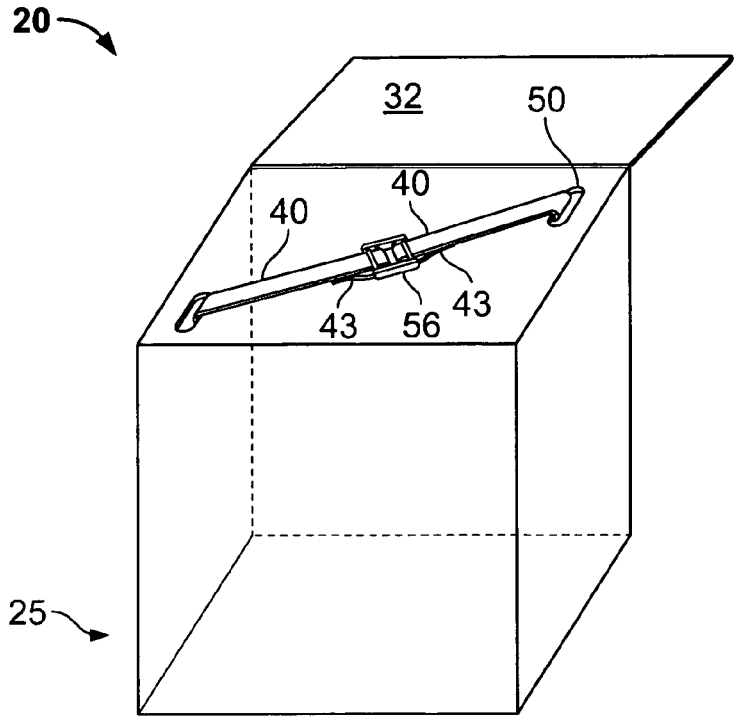
Figure 7:
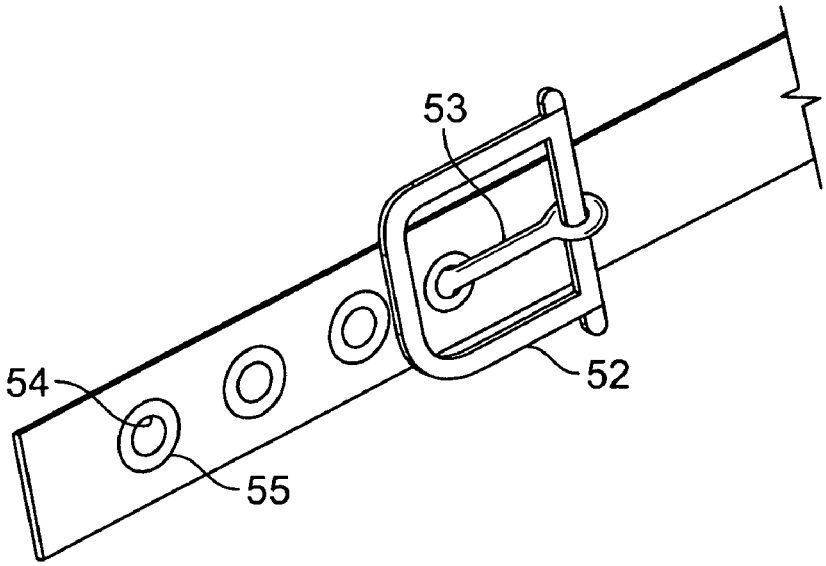
FIG. 7 shows a detailed view of one embodiment of a cinch buckle useable with a bulk container according to principles of the present invention.
Figure 8:
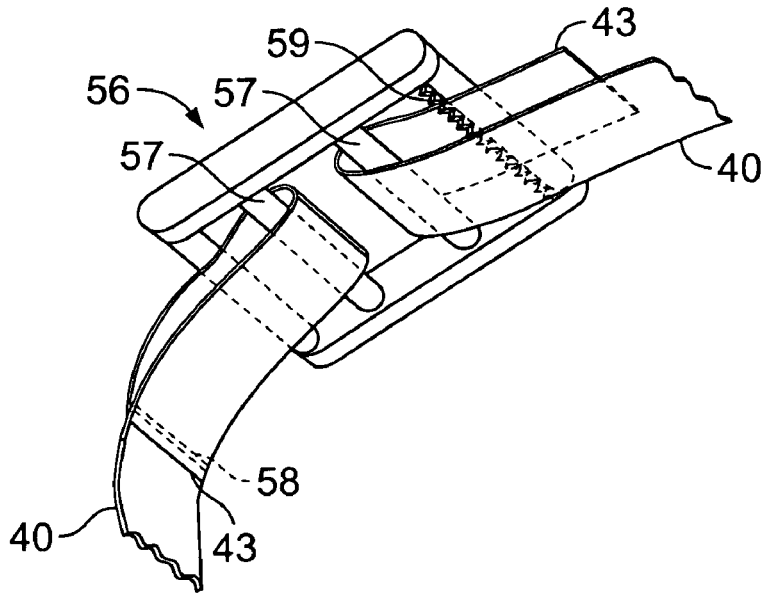
FIG. 8 shows a detailed view of a second alternative embodiment of a buckle useable with a bulk container according to principles of the present invention.

As shown in FIGS. 5, 7, and 8, straps 40 may further include a fastening means for releaseably joining ends 43 of the straps together and locking down flaps 31, 33 and 34. In one embodiment of a fastening means shown in FIG. 7, a conventional buckle 52 is provided on one strap 40 with the remaining strap 40 includes a plurality of spaced-apart holes 54 for receiving elongated tongue 53 of the buckle. Holes 54 may be reinforced by attaching grommets 55 to the strap 40 as shown. Alternatively, a self-tightening type of fastening means may preferably be provided. For example, in one embodiment shown in FIG. 8, a self-tightening fastening means includes free end 43 of one of the straps 40 having a commercially available one-way, self-tightening cinch buckle 56. Free end 43 of one strap 40 is passed over and under one transverse bar 57, and secured back onto itself with stitching 58 to form the stationary strap. The moving strap is formed by free end 43 of the remaining strap 40 having a plain end. The plain end is looped over and under another transverse bar 57 as shown so that pulling on the plain free end 43 continuously tightens or cinches up straps 40 together. Teeth 59 are typically provided on a transverse end piece of buckle 56 to grip strap 40 in a direction opposite the tightening direction. This prevents the strap 40 from loosening once tightened, unless the strap is manually lifted out of engagement with teeth 59 and fed back through buckle 56.

It will be appreciated that other suitable commercially-available fastening means may be used to hold free ends 43 of straps 40 together so long as the top flaps may be interconnected and mutually secured together to close the top of bulk container 20. Accordingly, the invention is not limited in this regard.

Because the bulk containers 20 are expected to be immersed and subjected to rushing water and/or wave action when used in a shoreline erosion control application, it will be appreciated that some of the bulk fill material stored in the containers may escape through top opening 29 without some provision for adequately closing and securing the top down. Accordingly, the foregoing top closure system using multiple overlapping flaps that are secured together provides one possible means for enclosing the top of the bulk container. Advantageously, the multiple layers of fabric created by overlapped top closure flaps 31, 32, 33, 34 reduce the chance that substantial fill material loss may occur. Straps 40 threaded through apertures 50 in top flaps 31, 33 secures the multiple top flaps 31, 33, 34 together to resist the forces of the water and waves which will try to pull the top flaps open. And finally, fastening means such as buckles 52, 56, or similar means for holding free ends 43 of the straps 40 together completes the top closure system by positively locking flaps 31, 33 and 34 down. Thus, these features of the present invention provide a resulting bulk container with a significant advantage over known bulk containers for shoreline erosion control applications or any other applications where the need to have a secure top closure is desired.

Figure 6:
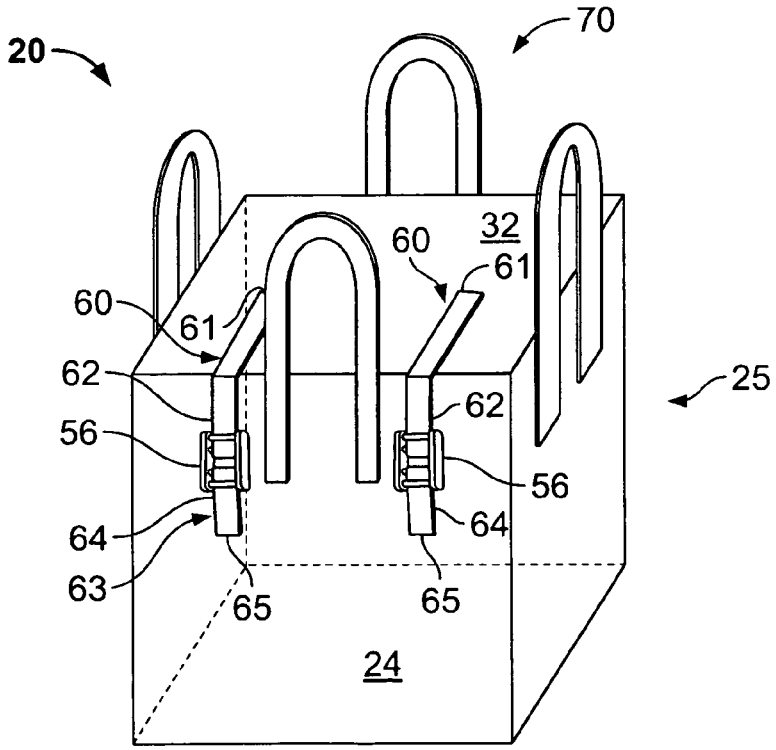

Referring now to FIGS. 2 and 6, top flap 32 of bulk container 20 may further include at least two straps 60 each having a fixed end 61 attached to top cover flap 32 and a free end 62. Front sidewall panel 24 may have a complimentary pair of straps 63 each having a fixed end 65 attached to panel 24 and a free end 64. Fixed ends 61, 65 may be attached to flap 32 and panel 24, respectively, in a similar manner described above for fixed ends 41 of strap 40 such as by stitching. Preferably, straps 60, 63 are made of woven material used for automotive seat belts similar to straps 40 described herein. Preferably, straps 60, 63 may be at least 1 inch wide; and more preferably are at least 2 inches wide. Free ends 62 or 64 of each pair of straps 60, 63 may be provided with a fastening means such as buckle 52 as shown in FIG. 7 to secure the free ends of each pair of straps together. The other free end 62 or 64 not furnished with a buckle 52 is preferably provided with apertures 54 for receiving tongue 53 of the buckle. Alternatively, a self-tightening cinch buckle 56 as shown in FIG. 8 may be provided.

The pairs of straps 60, 63 and buckles 52 serve a similar function as straps 60 and buckle 52 shown in FIG. 5, which in this instance is to provide a fastening means for releaseably joining free ends 62, 64 of straps 60, 63 together to lock down top flap 32 to bulk container 20. This helps to ensure that top flap 32 is not readily opened by wave action, thereby exposing already folded over flaps 31, 33, 34 and straps 60 with buckle 56. Furthermore, top cover flap 32 provides some protection against curious persons visiting the shoreline from tampering with buckle 52 of straps 40 which are covered and hidden by flap 32. Therefore, flap 32 when locked down on bulk container 20 provides at least an extra barrier which must be undone to gain access to straps 40.

It will be appreciated that any other suitable commercial fastening means may be used to hold free ends 62 and 64 together so long as the top cover flap 32 may be suitably secured to the bulk container. Alternatively, free ends 43 may simply be tied together in a knot. Accordingly, the invention is not limited in this regard.

Figure 9:
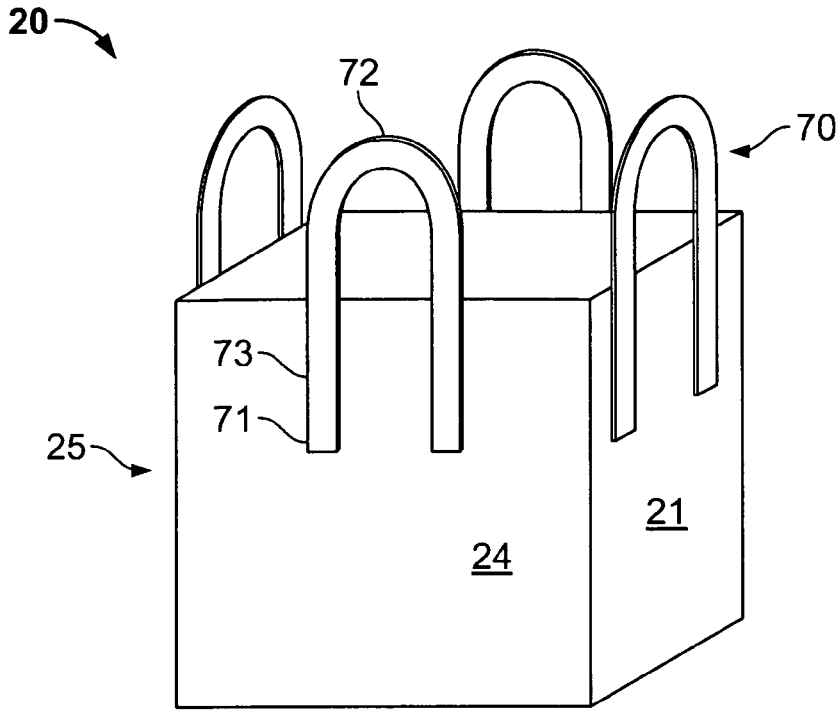
FIG. 9 shows the bulk container body of FIG. 1 with one possible embodiment of lifting straps useful for transporting a bulk container.

As shown in FIG. 9, the preferred means for lifting bulk container 20 are straps which are configured and attached to the container to form lifting straps 70. Lifting straps 70 are adapted and shaped to be engaged by a forklift, backhoe, crane, or similar motorized construction equipment to allow a heavy filled bulk container to be transported and maneuvered into position. Any suitable material may be used for lifting straps 70. Preferably, lifting straps 70 may be made from the same automotive seat belt strapping as top closure straps 40 described above. Preferably, lifting straps 70 are at least 2 inches wide. It will be appreciated that any suitable material or width may be used for lifting straps 70 so long as the suspended load of a filled bulk container may be sufficiently supported.

Referring still to FIG. 9, in the preferred embodiment an 8-point attachment system having four lifting straps 70 is provided. Each lifting strap 70 includes two spaced-apart legs 73 with ends 71 which are attached to body 25 of bulk container 20 along at least a portion of the legs. Preferably, lifting strap 70 is attached to body 25 by stitching, although other suitable known means such as welding, adhesives, etc. may be used. Lifting strap legs 73 are preferably attached to body 25 of bulk container 20 by an amount and number of rows of stitching sufficient to provide adequate strength for supporting a filled bulk container while it is suspended in air. Lifting strap 70 is configured and attached to bulk container 20 in a manner to form an open curved portion 72 that may be engaged or hooked by the aforementioned construction equipment. In one possible embodiment shown in FIG. 9, the four lifting straps 70 are arranged so that one lifting strap is attached to each sidewall panel 21, 22, 23, and 24. In one possible embodiment as shown, each lifting strap 70 may be positioned so that the curved portion 72 of the loop is approximately aligned with the vertical centerline or axis of each sidewall panel. Although ends 71 and legs 73 of the lifting strap 70 are shown extending approximately halfway down each sidewall panel 21, 22, 23, 24, it should be recognized that any suitable vertical extent of attachment length may be provided depending on the weight of the bulk container load to be supported. Accordingly, lifting strap legs 73 in some possible embodiments may extend from top edge 26*a* of a side panel all the way down to the bottom panel 27 (not shown) or, strapping 70 be one single length wrapping completely around the bottom of bulk container 20 from the top edges 26*a* of two opposite sidewall panels (e.g., panels 21, 23) to form a continuous U-shaped strap (not shown).

Figure 13:
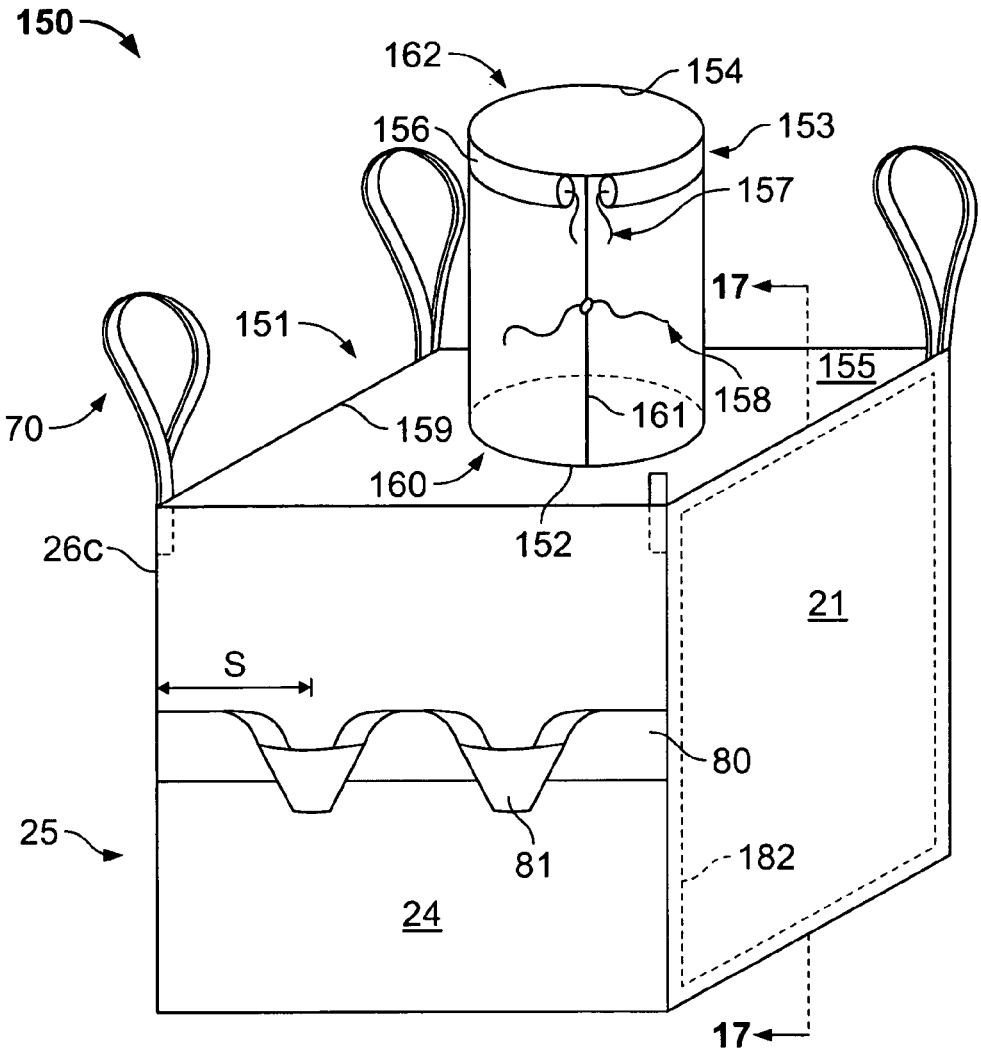
FIG. 13 shows a front perspective view of the container body of FIG. 1 with a second embodiment of a closeable top and other appurtenances.

In another possible embodiment shown in FIG. 13, four lifting straps 70 are provided which may be secured at each corner of bulk container 150. In one embodiment, free ends 71 and at least a portion of leg 73 are preferably stitched to body 25. Legs 73 may be sewn into the vertical corner seams between the sidewall panels at the same time the corner seams are made.

It will be appreciated that other numerous variations of suitable lifting means may be used wherein the number of lifting straps provided, their configuration, arrangement on bulk container 20, etc. differ from the preferred embodiment described and shown herein. For example, one alternative means for lifting the bulk container may have an 8-point attachment system configured such that the spaced-apart strap legs 73 straddle each top corner so that four loops are arranged diagonally across from each other at the corners (not shown). In another possible embodiment, the lifting means may be provided by a pair of elongated parallel horizontal sleeves formed out of the bulk container 20 fabric itself along the top edges 26*a* of two opposite sidewall panels (e.g., panels 21, 23) through which the rails of a forklift may be inserted (not shown). Accordingly, many variations of lifting straps are possible and the invention is not limited to the preferred embodiment described herein.

The preferred method of filling and closing a bulk container 20 will now be described with reference to FIGS. 2-6. The bulk containers 20 may be filled at a remote site and transported to the intended final installation site. Alternatively, bulk containers 20 are preferably transported empty to the final installation site and are filled there. This provides the opportunity to fill the bulk containers with either materials trucked to the site or with local materials from the site if desired such as existing beach sand which can then be returned to the environment when the containers are emptied. Therefore, no foreign materials need be introduced into the seaside environment. Bulk containers 20 may be filled and then lifted into their final position or placed in the final position and then filled.

Figure 3:
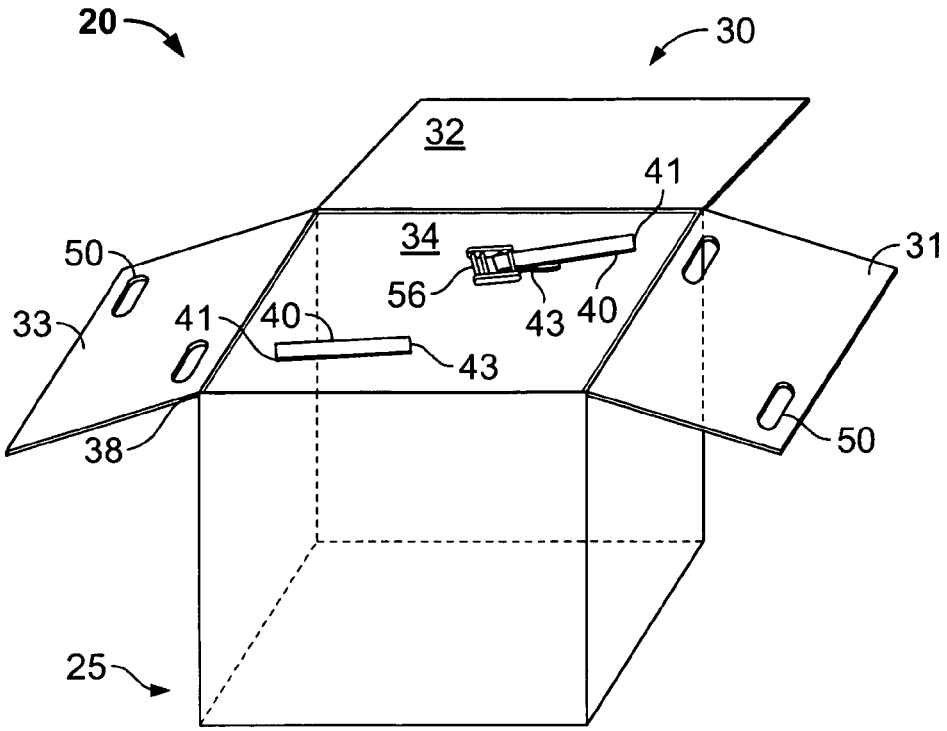
Figure 4:
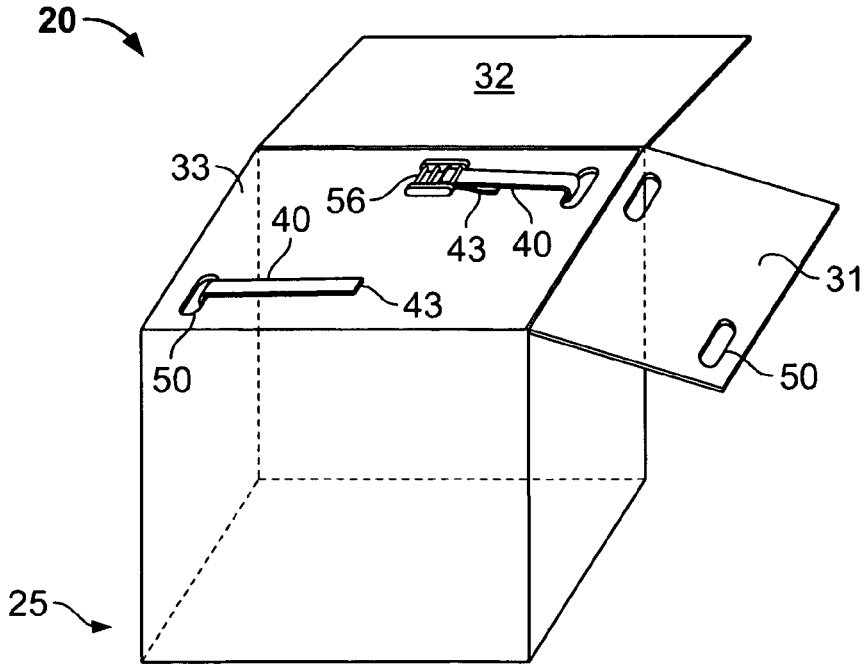

After the desired fill material is placed in bulk container 20, flap 34 is first closed over open top 29 as shown in FIG. 3. Next, either flap 31 or 33 is folded over flap 34. In FIG. 4, flap 33 is shown folded over flap 34 while at the same time threading both straps 40 attached to flap 34 through holes 50 in flap 33. Flap 31 is then folded over flap 33 as shown in FIG. 5 while threading straps 40 through holes 50 in flap 31. Free ends 43 of straps 40 are secured together and tightened using buckle 56 (FIG. 7) as shown in FIG. 5.

As shown in FIG. 6, the final top flap 32 is next folded over flap 31 and secured down to bulk container 20 using straps 60 and 63 which are joined together by self-tightening buckle 56. Accordingly, top opening 29 of bulk container 20 is now covered by four layers of overlapping flaps 31, 32, 33, and 34. When bulk container 20 is used in a shoreline erosion protection application, the multiple overlapping flap arrangement helps prevent a substantial amount of bulk fill material such as sand from being washed out of the containers by wave action. Flap 32 also serves to cover and protect straps 40 and buckle 54 which are the primary means of securing underlying flaps 31, 33, and 34 together. Flap 32 further conceals straps 40 and makes access thereto more difficult to persons who may attempt to tamper with the bulk containers.

The contents of bulk container 20 may subsequently be removed by opening the top flaps in a reverse fashion (i.e., opening the strap buckles and top closure flaps, and inverting the bag to empty its contents.

FIG. 13 shows a second possible embodiment of a bulk container. Bulk container 200 has an alternative means for closing open top 29 of bulk container body 25. In this embodiment, a top cover 150 includes top panel 155 having edges 159 that are joined to top edges 26*a* of body 25 which may be the same as shown in FIG. 1 and described herein. Top panel 155 defines a preferably circular opening 152 to which is joined one end 160 of an elongated cylindrical tube 153. Tube 153 may be joined to top panel 155 by any suitable means, such as stitching or welding. The tube may have a vertical seam 161 as shown. Tube 153 also has a second free end 162 defining an aperture 154 through which bulk fill material may be added to and removed from bulk container 20 via tube 153. A means for closing tube 153 is provided which in one embodiment may include a drawstring 157 moveably secured to free end 162 of tube 153 by forming a pocket 156. The pocket may be formed by rolling over and stitching the edge of the tube to itself providing an annular cavity in which drawstring 157 may be threaded. Pulling drawstring 157 tightens and closes the aperture 154 on the tube. Drawstring 157 may then be knotted to secure the closure. A pair of fixed tie-off strings 158 may also be provided which are spaced apart from drawstring 157 and located lower on tube 153. The ends of string 158 are wrapped around tube 153 to cinch the tube closed and then are knotted together. Alternatively, only fixed strings 158 may be provided in lieu of drawstring 157.

Tube 153 may be made from any suitable material so long as the tube has sufficient flexibility to allow it to be drawn together by the drawstring and/or fixed string. In one embodiment, tube 153 is made from coated polypropylene. The drawstring and fixed string may be made from any suitable material, such as narrow sections of seat belt-type strapping as described herein in conjunction with strapping 40. The strapping should preferably be narrow enough to allow the free ends of the drawstring or fixed strings to be tied together.

A preferred method for filling and closing bulk container 150 shown in FIG. 13 includes filling the container with a fill material, such as sand for example, through cylindrical tube 153. Drawstring 157 is next pulled tight to close aperture 154 at the top of tube 153. It should be noted that as the tube fabric is cinched together by pulling the drawing, the fabric will pucker and it may not be possible to completely close off aperture 154. Fixed strings 158 are tightly wrapped around tube 153 and the free ends are knotted together. The bulk material contents of bulk container 150 are now secured within and resistant to being washed from the container by rushing water and/or wave action. The contents of the bag may subsequently be removed by opening the drawstring and fixed strings, and inverting the container to empty its contents.

Figure 17:
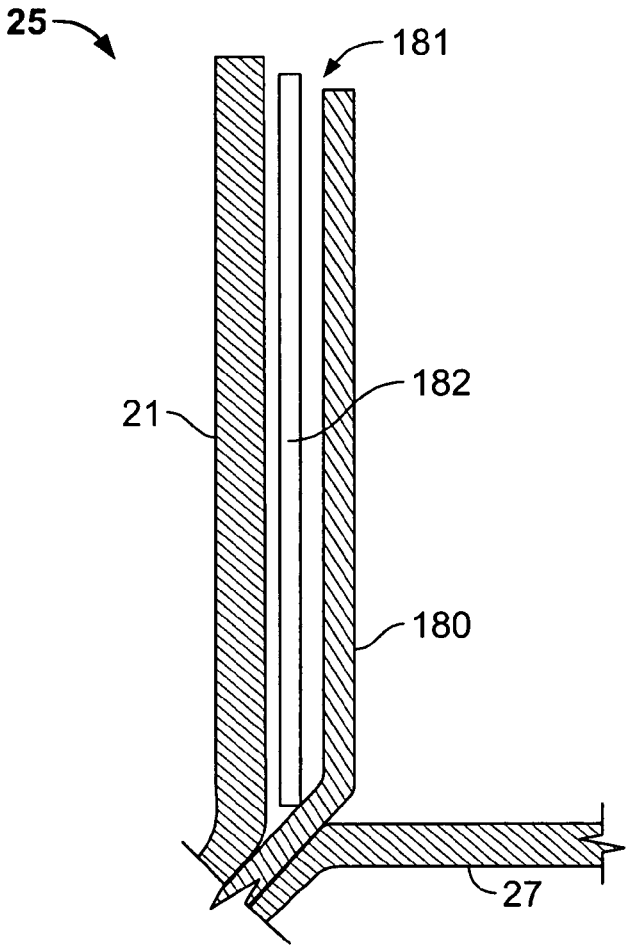
FIG. 17 shows a cross section through one embodiment of a sidewall taken from FIG. 13 having one possible embodiment of a stiffening member for reinforcement of the sidewall.

FIGS. 13 and 17 show a bulk container having sidewall panels that may be stiffened to provide some rigidity to the container and maintain a more substantially rectilinear shape when filled with a bulk material. This is advantageous when constructing a barrier wall system as described herein where it is desirable to be able to snugly abut adjacent bulk containers. Stiffened sidewalls according to one possible embodiment described herein may be used with bulk containers 20 or 150, or any other bulk container. FIG. 17 shows a cross section through a typical sidewall panel that is stiffened.

Referring to FIG. 17, sidewall panel 21 is preferably placed adjacent sidewall panel 21 and may be configured to hold a stiffening member 182. Preferably, stiffening member 182 is located close enough to sidewall panel 21 so that the weight of the bulk material will force the stiffening into contact with the sidewall panel. The load produced by the weight of the bulk material will then be distributed to sidewall panel 21 through stiffening member 182.

In one embodiment, sidewall panel 21 is configured with a pocket 180 to hold a stiffening member 182. The pocket may be formed by attaching a panel of material to sidewall panel 21 along three edges to create an opening 181 adjacent the remaining edge of the pocket. Preferably, opening 181 is located at the top of pocket 180. Pocket 180 may be stitched into the edges of adjoining sidewall panels and the floor panel 27 when the bulk container is fabricated, as shown in FIG. 17. Alternatively, pocket 180 may be stitched or attached to sidewall panel 21 directly by any other suitable means such as by welding, fusion, adhesives, etc. Preferably, pocket 180 has a width and height that is approximately coextensive with the width and height of the sidewall panel to which it is attached to maximize resistance of the sidewall panel to bulging when the bulk container is filled with bulk material. Pocket 180 may be made of any suitable flexible material, such as a coated polypropylene sheet in one preferred embodiment.

Stiffening member 182 may be rigid or semi-rigid in design, and is preferably substantially planar having the general shape of a relatively thin panel or sheet with a height and width substantially larger than its thickness. Stiffening member 182 is also preferably approximately coextensive in width and height to the sidewall panel intended to be reinforced and is sized to fit into pocket 180. In some possible embodiments, stiffening member 182 may be a solid sheet of material or have apertures therein such as a mesh or perforated sheet. In some possible embodiments, stiffening member 182 may be made of metal, plastic, cardboard (preferably coated to be water resistant) or other suitable material that will provide some degree of rigidity to the sidewalls. Preferably, at least one sidewall panel may contain a stiffener if used. More preferably, all four sidewall panel 21-24 have a stiffening member 182.

In other possible embodiments, it is contemplated that stiffening member 182 may be attached directly to the sidewall panel intended to be reinforced with the use of a pocket. Accordingly, stiffening member 182 may be directly attached to sidewall panel 21 by stitching, adhesives, or other suitable methods. It is contemplated that in some embodiments stiffening member 182 may flex and bend under the weight of the bulk material. Accordingly, stiffening member 182 is not expected to completely prevent the sidewalls of the bulk container from bulging, but instead control and reduce bulging in some embodiments.

According to a further aspect of the invention, a bulk container system is provided that is comprised of a plurality of interlinked individual bulk containers. Whereas known bulk containers have been limited in use primarily for storing bulk materials, the ability to positively and securely link a plurality of bulk containers together in the manner described advantageously permits the creation of a structural barrier wall with suitable strength to resist externally applied loads, such as those imparted by rushing water and/or wave action for example, which would otherwise dislodge and scatter individual bulk container units. Such a bulk container system wall may be beneficially employed as a bulkhead or barrier for shoreline erosion protection or flood control applications. Accordingly, the bulk container system of the present invention expands the possible uses and exploits the advantages of known bulk containers in a manner heretofore not fully appreciated in the art.

A bulk container 20 suitable for forming an interlinked bulkhead or barrier wall preferably includes a means for linking a plurality of bulk containers together. In one embodiment, the linking means may include at least one sidewall panel preferably having at least one linking loop 81 and a connecting member such as a tensionable belt 90 to connect the linking loops together on adjacent abutted bulk containers. Preferably, at least the front sidewall panel is provided with the linking means. In another embodiment, linking loops 81 may be attached to or form an integral part of at least one horizontally-extending linking strap 80 attached to a sidewall panel. The combination of linking straps, loops, and connecting members form a lateral contiguous link that joins a plurality of bulk containers together. In an alternative embodiment, linking loops 81 may be attached directly to a sidewall panel as further described herein.

Figure 10:
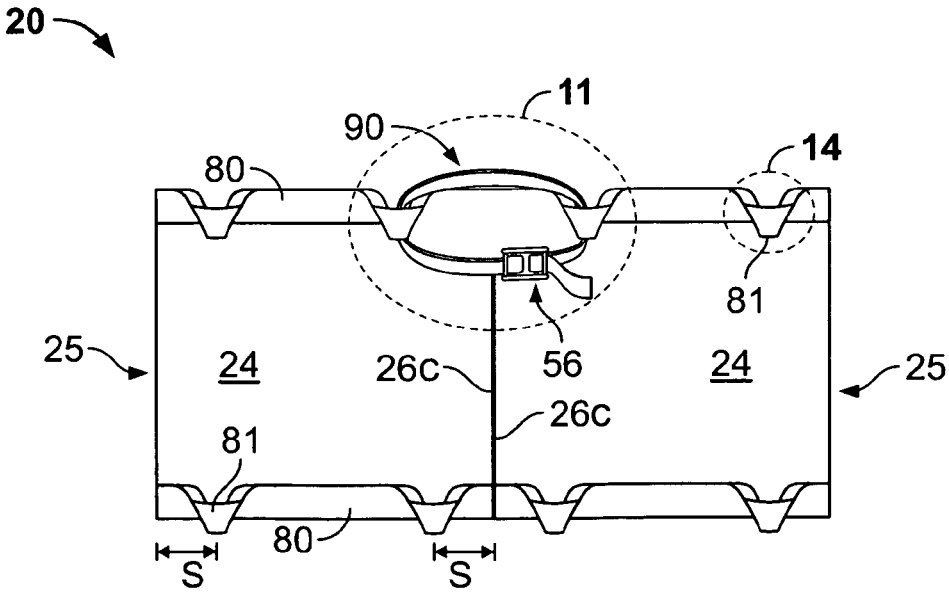
FIG. 10 shows the bulk container body of FIG. 1 with linking straps, linking loops, and a connecting member for creating an interlinked bulk container wall system.

Referring to one possible embodiment shown in FIG. 10, two horizontally extending linking straps 80 may be provided as shown. In this embodiment, a linking strap 80 each may be attached to body 25 of bulk container 20 at or near the top edge 26*a* and lower edge 26*b* of preferably at least one sidewall panel 24. In other embodiments, the linking straps 80 may extend horizontally along at least two or more sidewall panels 21-24. Linking straps 80 are preferably made from the same automotive seat belt strapping as top closure straps 40 described above. Preferably, linking straps 80 are at least 2 inches wide; however, any suitable width may be used.

Figure 14:
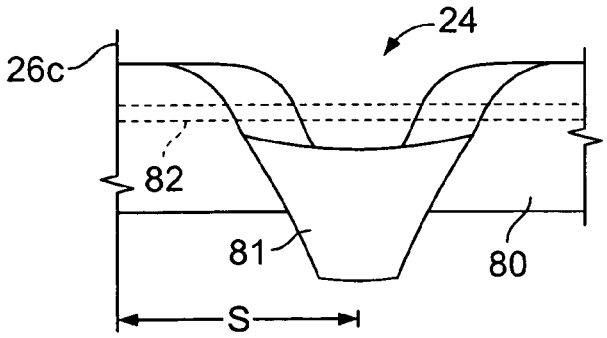
FIG. 14 shows a detailed front view of a linking loop according to principles of the present invention taken from FIG. 10.

Linking straps 80 may be attached to body 25 of bulk container 20 by stitching, adhesives, welding, or other suitable methods known in the art. If stitched to bulk container 20, linking straps 80 are preferably stitched to bulk container 20 using at least one row of stitching, more preferably at least two rows of stitching as shown in FIG. 14. Preferably, linking straps 80 are attached to bulk container 20 across substantially the entire width WB of the sidewall panel to which they are attached to better distribute tensile loads caused by rushing water and/or wave action striking the interlinked bulk containers over a larger surface area than if the straps were attached to only a smaller portion of the sidewall width. This results in lower unit stresses (e.g., pounds per square inch) on the container sidewall panel and reduces the possibility of tears developing in the container fabric which could possibly result in failure of strap-to-sidewall attachment. However, it should be noted that linking straps 80 may be attached to the bulk container across only a portion of the entire width WB of the sidewall panel depending on the specific application needs, method of attaching the straps to the container, and estimated tidal or fluid forces on the containers.

Reference is now made generally to FIGS. 10-15. Each linking strap 80 preferably includes at least one linking loop 81 for linking together two adjacent bulk containers. More preferably, at least two spaced-apart linking loops 81 are provided for each bulk container for linking two or more adjacent bulk containers 20 together. In one embodiment, linking loops 81 preferably project generally in a lateral direction outward from the sidewalls. The optimum placement of linking loops 81 on bulk container 20 will depend in part on the length of the loop. Preferably, loops 81 of a predetermined length are spaced away from each vertical edge 26*c* by a distance S (see FIG. 10) so that loops on adjacent containers do not touch when each are stretched toward sidewall panel vertical edge 26*c*. This allows sufficient room for tightening and tensioning a connecting member such as belt 90 described herein (see, e.g., FIGS. 10 & 11) that may be used for interconnecting a pair of loops (i.e., one each on adjacent bulk containers 20). The properly tensioned connecting creates a snug relationship between adjacent abutted bulk containers to best resist the forces of incoming rushing water and/or wave action which will try to dislodge containers from the interlinked wall. In one preferred embodiment, distance S may typically be about 4 inches; however, any suitable distance may be provided. In a preferred embodiment, linking loops 81 are short enough in length and positioned on the bulk container so that the loops on adjacent containers do not touch. It should be noted that in other possible embodiments, linking loops 81 may either be disposed at the sidewall vertical edge 26*c* and/or be long enough so that loops on adjacent bulk containers can be stretched to touch each other depending on the type and size of connecting member used to interconnect the loops.

In one embodiment, linking loops 81 are preferably configured and sized to be large enough to receive a connecting member therethrough (for example, such as belt 90 described herein), but not too excessively large to minimize excess play (defined herein as a possible range of horizontal and/or vertical movement or a combination thereof) when the connecting member is coupled through the loops. Also preferably, linking loops 81 are also kept as short as possible in length to limit their projection from the bulk container. This also reduces excessive play in the loops which is contrary to establishing a snug, tensioned relationship between interlinked adjacent bulk containers. Accordingly, linking loops 81 are preferably substantially shorter in length than lifting straps 70 which must be long enough to allow proper rigging by lifting equipment used for moving the container. For example, bulk containers are commonly rigged by placing all four lifting straps 70 over a single hook on a crane. Therefore, lengths of typically 10-12 inches are not uncommon for lifting straps 70, whereas linking loops 81 may preferably be typically on the order of 3-4 inches in length in some possible embodiments.

Preferably, linking loops 81 are formed integral with linking strap 80 to maximize the strength of the attachment between the loop and bulk container 20. In one embodiment, a loop 81 may be formed in strap 80 while it is being stitched to bulk container 20 by stitching 82 down a portion of the strap 80 on itself as shown in FIG. 14. However, other possible ways of constructing an integral linking loop 81 in linking strap 80 may be used. In other possible embodiments, loop 81 may be a separate piece of strapping or other device (e.g., metallic or plastic rings, etc.) that may be attached to linking strap 80 or directly to bulk container 20 by any suitable method such as by stitching, adhesives, etc. In another possible embodiment shown in FIG. 16, linking loop 81 is formed as an integral part of lifting strap 70 as it is being stitched to bulk container 20. Accordingly, the invention is not limited by the material or manner of forming and attaching loops 81 to bulk container 20, or by their placement on the container.

An alternative embodiment of a linking strap 80 arrangement is shown in FIG. 13 in which a single strap is provided on at least one sidewall panel of a bulk container 150. Single linking strap 80 may be vertically centered on sidewall panel 24 in one possible embodiment as shown or placed in any other suitable vertical position. Two-spaced apart linking loops 81 may be provided in a similar manner described herein for FIG. 10. Preferably, a second strap 80 with loops 81 may be provided in a similar manner on rear sidewall panel 22 opposite sidewall panel 24 as shown for flexibility in constructing an interlinked bulk container wall and to maximize the ability of the wall to resist the forces of rushing water and/or wave action which will attempt to push the wall apart.

With reference to FIGS. 10, 11, 12, and 15, the means for interlinking bulk containers 20 together further includes a connecting member such as belt 90 in one possible embodiment which is received through loops 81 on two adjacent bulk containers 20 as shown. Preferably, belt 90 is capable of being adjustably tightened when engaged with the loops on adjacent bulk containers to create a snug and tensioned relationship between the linked bulk containers. Belt 90 serves to connect linking straps 80 on adjacent bulk containers via linking loops 81, and in effect creates essentially a long, almost continuous pre-tensioned linking strap spanning across the sidewall faces of a plurality of bulk containers 20 that are linked together. This arrangement advantageously provides optimum resistance to the forces of rushing water and/or wave action which will attempt to separate the bulk container wall. In one embodiment, belt 90 has two free ends 91, 92 which may be joined together and the belt tightened preferably by using a self-tightening cinch buckle 56 similar to that shown in FIG. 8 described herein. However, any other suitable buckle or joining means may be used so long as ends 91, 92 may be joined together and belt 90 tightened. As noted herein, loops 81 are preferably spaced by distance S away from sidewall panel vertical edges 26*c* so that as belt 90 is tensioned or tightened, the linking straps may be pre-tensioned and in addition the vertical edges of adjacent bulk containers 20 advantageously tend to be pulled together. This spacing S also preferably provides sufficient clearance to accommodate the physical width of buckle 56 or other fastening means so that the belts to be properly tightened or tensioned which would otherwise be difficult if, for example, loops 81 were located proximate to the vertical edges 26*c* of adjacent bulk containers. However, it should be noted that in other possible embodiments, loops 81 may be placed at the vertical edges 26*c* of each bulk container 20 for possible use with alternative connecting members such as clips, clasps, openable/closeable rings, one-way tightening wire ties, etc., that may be used to connect linking loops 81 together and require less clearance than belts 90.

Belt 90 may be preferably made from the same automotive seat belt strapping as top closure straps 40 described above, or from any other suitable material so long as bulk containers 20 may be securely interlinked together using loops 81. Any suitable width may be used for belt 90 provided the belt may be passed through loops 81. It should be noted that loops 81 may be joined by any other suitable means other than a belt, such as clips, openable/closeable metal or plastic rings, roping, etc. Accordingly, the invention is not limited by the few possible examples of connecting members used to connect loops 81 together described herein.

Loops 81 may be used not only to horizontally interlink bulk containers 20 together, but may also be used to interlink bulk containers together to form vertically-stacked walls using the same interlinking loops 81 described herein. Vertically-stacked walls will be further described herein.

Figure 11:
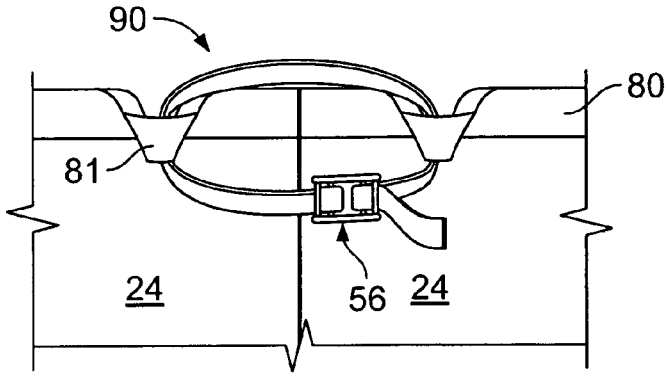
FIG. 11 shows a detailed view of a linking strap, linking loop, and connecting member taken from FIG. 10.
Figure 12:
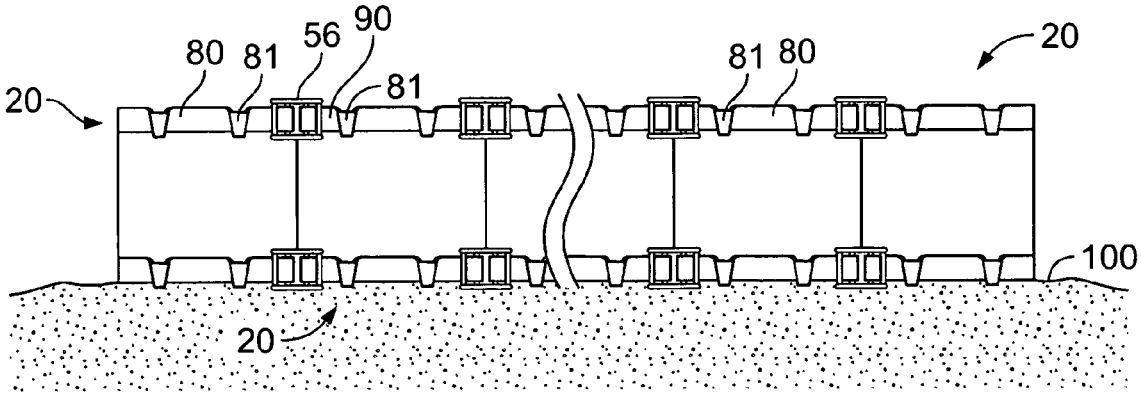
FIG. 12 shows a front view of an interlinked bulk container wall system formed with the containers shown in FIG. 10 and in which certain appurtenances omitted for clarity.
Figure 15:
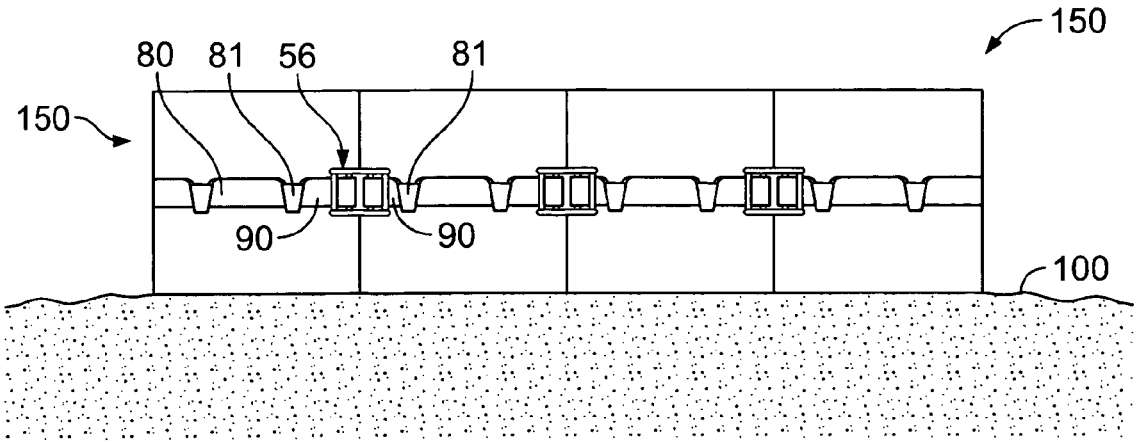
FIG. 15 shows a front view of an interlinked bulk container wall system formed with the containers shown in FIG. 13 and in which certain appurtenances have been omitted for clarity.

A bulk container system and method of forming a barrier wall useable in shoreline erosion control applications will now be described with reference to one possible embodiment shown in FIG. 12. The barrier wall shown in FIG. 12 is formed from a plurality of bulk containers 20 having features and being interlinked in accordance with the principles described herein. The various appurtenances of bulk container 20 not used in linking the containers together are omitted from FIG. 12 to more clearly show the linking technique. The bulk container system shown forms a portion of single-tiered wall which may be a bulkhead or barrier used to mitigate the effects of shoreline or beach erosion, or for flood control applications. Filled bulk containers 20 may be positioned on a beach area 100, abutted against each other, and then interlinked by passing belts 90 through a pair of loops 81 on adjacent bulk containers (i.e., one loop on each container). Alternatively, empty bulk container 20 may be placed adjacent each other and then filled with bulk material. Free ends 91, 92 of belt 90 may then be fastened together using cinch buckle 56 as shown in FIGS. 10 and 11 or any other suitable joining means. Adjacent bulk containers 20 are preferably abutted snugly against each other to form relatively close joints between the sidewalls of the containers to reduce the amount of water that may wash through gaps left between the containers. Although two belts 90 are preferably used to link together two adjacent bulk containers as shown (i.e., four loops 81 joined by two belts 90), it will be appreciated that in other possible embodiments only one belt may be used to join a single pair of horizontally spaced apart loops 81 occupying either the top or bottom position. Alternatively, if bulk container 150 shown in FIG. 13 is used, then only one belt 90 would preferably be used to join a single pair of loops 81 together from adjacent containers (as shown in FIG. 15).

Using the bulk containers and technique for interlinking them together described herein, a bulkhead or barrier may be formed of any desired length and lateral layout (when viewed from above), such as a straight wall, curved wall, serpentine wall, etc. as required by the particular application. In addition, a wall may be formed having two or more rows deep of interlinked bulk containers (not shown). Preferably, each row of bulk containers may be interlinked using loops 81 and belts 56 in the general manner described above. Also preferably, the vertical edges 26*c* of the bulk containers 20 or 150 in a first horizontal row are staggered with the vertical edges of containers in at least the second row to prevent water from rushing directly through the first and second rows. In addition, successive rows of bulk containers 20 or 150 may be joined using a similar technique of linking loops 81 and belts 90 described herein.

A bulk container system is shown in the form of a barrier wall may also extend vertically. An interlinked wall having at least two or more vertical tiers of bulk containers 20 may be formed by stacking containers on top of one another (not shown). Linking loops 81 and belts 90 as described herein may be used to both horizontally and vertically link bulk containers 20 together in the same manner already discussed herein. The same loops 81 may have two belts 90 passed through each, one for linking to a loop on an adjacent horizontal bulk container 20 and another for linking to a loop on an adjacent vertical bulk container 20. Alternatively, separate loops 81 may be provided on each bulk container 20 for horizontal linking and vertical linking with the exact location of the loops being determined by the particular application intended. In addition, one or more linking straps 80 may be placed in any desired position or orientation on the container (i.e., horizontal, vertical, or diagonal) depending on the needs of each particular application. Accordingly, the invention is not limited as to the number, location, and orientation/direction of linking loops 81 or linking straps 80 provided on the bulk container. In other embodiments, the first and second vertical tier of bulk containers 20 may be horizontally linked, but not vertically linked. In addition, to provide vertical stability to the bulk container wall, a second horizontal row of bulk containers may be provided as described herein and the second tier (or more) of bulk containers may be offset horizontally rearwards from the face of the front row of bulk container's.

Figure 16:
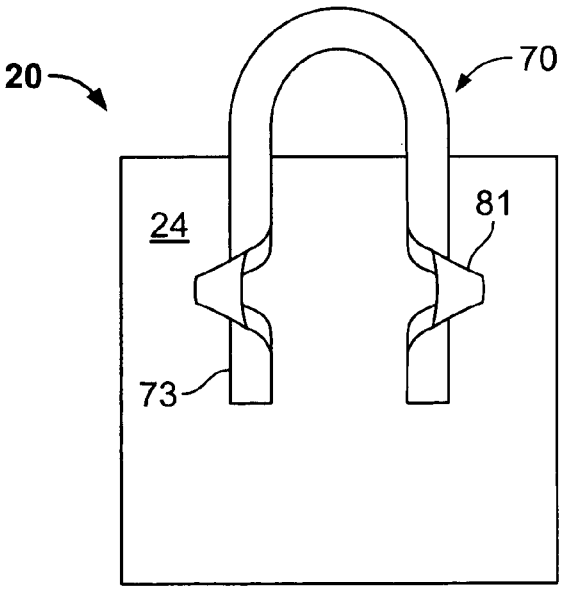
FIG. 16 shows one embodiment of a lifting strap useable with bulk container body of FIG. 1 in which the linking loops of FIG. 14 are incorporated with the lifting straps.

Although FIGS. 16 and 17 show a two-tiered barrier wall using bulk container 20 of FIG. 10 having two vertically-spaced linking straps 80 on a sidewall panel, the bulk container 150 of FIG. 13 may also be used to create vertically-stacked barrier walls.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A bulk container suitable for forming an interlinked wall of a plurality of containers, the container comprising:

a bottom;

a top changeable in configuration from an opened condition to a closed condition;

a plurality of sidewalls extending between the top and bottom;

a horizontally extending strap attached to at least two of the plurality of sidewalls;

a lifting strap attached to at least a portion of one of the plurality of sidewalls for transporting the container;

at least two linking loops attached to the horizontally extending strap; and at least one connecting member sized and configured to be received through at least one of the at least two linking loops and to interlink with an adjacent bulk container.

2. The container of claim 1, wherein the connecting member is a belt.

3. The container of claim 2, further comprising the belt having two ends and a buckle to releaseably join the two ends.

4. The container of claim 1, wherein the at least two linking loops are formed as an integral part of the horizontally extending strap.

5. The container of claim 1, wherein the at least two linking loops are attached as separate components to the horizontally extending strap.

6. The container of claim 1, wherein the top includes an elongated tube that communicates with an interior cavity of the bulk container for storing a bulk material, the tube being closeable.

7. The container of claim 6, wherein the tube includes at least one pair of strings for closing the tube.

8. The container of claim 1, wherein the bulk container is made of woven polypropylene fabric.

9. The container of claim 1, further comprising a second bulk container as described in claim 1, the two containers abutted against each other, and wherein the connecting member of one of the two containers engages at least one of the at least two linking loops on each of the containers to form an interlinked wall.

10. The container of claim 1, wherein the at least two linking loops are spaced by a distance inwards from a vertical edge of the sidewall.

11. The container of claim 1 wherein the horizontally extending strap extends across substantially the entire width of a sidewall.

12. The container of claim 1 wherein the at least two linking loops are integral with and spaced apart along the horizontally extending strap.

13. The container of claim 1 wherein the horizontally extending strap is disposed approximately halfway between the top and bottom of the bulk container.

14. The container of claim 1 wherein the plurality of side walls are flexible and porous.

15. The container of claim 14 wherein at least one of said plurality of sidewalls includes a pocket configured to receive a removable stiff panel that mitigates bulging of the at least one of said plurality of sidewalls when said container is filled with solid bulk material.

16. A bulk container wall comprising:

a plurality of bulk containers according to claim 1 positioned in an abutting relationship, wherein the connecting member of at least one of the plurality of bulk containers is engaged with at least one of the at least two linking loops on an adjacent bulk container, whereby an interlinked bulk container wall is formed.

17. The container wall of claim 16, further comprising the top of each container including an elongated tube that communicates with an interior cavity defined by the plurality of sidewalls of the bulk container for storing a bulk material, the tube being closeable.

18. The container wall of claim 16 wherein at least one of said plurality of sidewalls of one of the plurality of bulk containers includes a pocket configured to receive a removable stiff panel that mitigates bulging of the at least one of said lurality of sidewalls when said one of the plurality of bulk containers is filled with solid bulk material.

19. A method of forming an interlinked wall from a plurality of bulk containers, the method comprising:

providing a plurality of bulk containers according to claim 1 filling each bulk container with a solid fill material;

positioning each bulk container in a laterally-abutting relationship with at least one other bulk container; and linking at least one of said at least two linking loops on each bulk container with at least one of said at least two linking loops on an adjacent bulk container to form an interlinked wall.

20. The method of claim 19, wherein the at least two linking loops of each bulk container project laterally outward from one of the plurality of idewalls of the bulk container.

21. The method of claim 19, further comprising linking at least one of said at least two linking loops on each bulk container with at least one of said at least two linking loops on an adjacent bulk container using the connecting member of one of the bulk containers.

22. The method of claim 21, wherein the connecting member is a closeable belt.

23. The method of claim 19, further comprising the step of stacking another wall of a plurality of bulk containers vertically on top of the wall formed by claim 19 by repeating the steps of claim 19.

24. The method of claim 19, wherein each bulk container is alternatively filled with the fill material after the positioning step.

25. The method of claim 19, wherein the positioning step includes placing each bulk container on a beach area.

26. The method of claim 19 wherein the linking step includes linking at least one of said at least two linking loops on each bulk container with at least one of said at least two linking loops on an adjacent bulk container using the connecting member of one of the bulk containers; and wherein the method further comprises manipulating the connecting member to pre-tension the horizontally extending strap of adjacent bulk containers.

27. The method of claim 19 wherein at least one of said plurality of sidewalls of one of the plurality of bulk containers includes a pocket configured to receive a removable stiff panel that mitigates bulging of the at least one of said plurality of sidewalls when said one of the plurality of bulk containers is filled with solid bulk material.

* * * * *